US006005537A

United States Patent [19]

Yokota et al.

[11] Patent Number: 6,005,537

[45] Date of Patent: *Dec. 21, 1999

[54] LIQUID-CRYSTAL DISPLAY CONTROL APPARATUS

[75] Inventors: Yoshikazu Yokota, Kodaira; Satoru Tsunekawa, Higashimurayama; Kimihiko Sugiyama, Tachikawa, all of Japan

[73] Assignees: Hitachi, Ltd., Tokyo; Hitachi Device Engineering Co., Ltd, Chiba, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/932,033

[22] Filed: Sep. 17, 1997

Related U.S. Application Data

[63] Continuation of application No. 08/308,830, Sep. 19, 1994, abandoned, which is a continuation of application No. 08/100,764, Aug. 2, 1993, abandoned.

[30] Foreign Application Priority Data

Aug. 21, 1992 [JP] Japan ..... 4-222502
Jul. 20, 1993 [JP] Japan ..... 5-179119

[51] Int. Cl.[6] ..... G09G 3/04

[52] U.S. Cl. ..... 345/33; 345/116

[58] Field of Search ..... 345/1, 3, 50, 33, 345/34, 87, 98, 116, 141, 192–194, 199

[56] References Cited

U.S. PATENT DOCUMENTS

| | | | |
|---|---|---|---|
| 3,803,589 | 4/1974 | Hatsukano et al. | 345/33 |
| 4,224,615 | 9/1980 | Penz | 345/50 |
| 4,414,545 | 11/1983 | Sakurada et al. | 345/87 |
| 4,482,894 | 11/1984 | Matsui et al. | 345/33 |
| 4,616,336 | 10/1986 | Robertson et al. | 345/116 |
| 4,639,721 | 1/1987 | Eto et al. | 345/116 |
| 4,692,760 | 9/1987 | Unno et al. | 343/33 |
| 4,827,251 | 5/1989 | Aoki et al. | 345/116 |
| 4,845,477 | 7/1989 | Shibata et al. | 345/199 |
| 5,135,398 | 8/1992 | Thornton et al. | 345/33 |
| 5,159,324 | 10/1992 | Ohtani et al. | 345/146 |

FOREIGN PATENT DOCUMENTS

| | | | |
|---|---|---|---|
| 3434118 | 3/1986 | Germany | 345/87 |
| 3-229298 | 10/1991 | Japan | G09G 5/36 |

OTHER PUBLICATIONS

HD44780 Hitachi User's Manual, Feb. 1984, pp. 1–12. (Provided in Japanese with English translation attached.).

*Primary Examiner*—Amare Mengistu
*Attorney, Agent, or Firm*—Fay, Sharpe, Beall, Fagan, Minnich & McKee

[57] ABSTRACT

The liquid-crystal display control apparatus provided by the present invention comprises a display RAM unit 21 for storing character codes, character-generator RAM and ROM units 22 and 23 for storing character font patterns and a segment RAM unit 24 for storing picture patterns such as marks and icons. When displaying a character, the following display control is carried out. First of all, a character code is read out from the display RAM unit 21 at a display address generated by a display-address counter 25. The character code is then used in conjunction with a raster address output by a line-address counter 26 for reading out a character font pattern from the character-generator RAM unit 22 or the character-generator ROM unit 23. When displaying a picture pattern such as a mark or an icon, on the other hand, the following display control is carried out. Display control information is read out from the segment RAM unit 24 at an address generated by the display-address counter 25. Dot-matrix characters and picture patterns such as marks and icons are displayed on the same screen on a time-division basis.

10 Claims, 4 Drawing Sheets

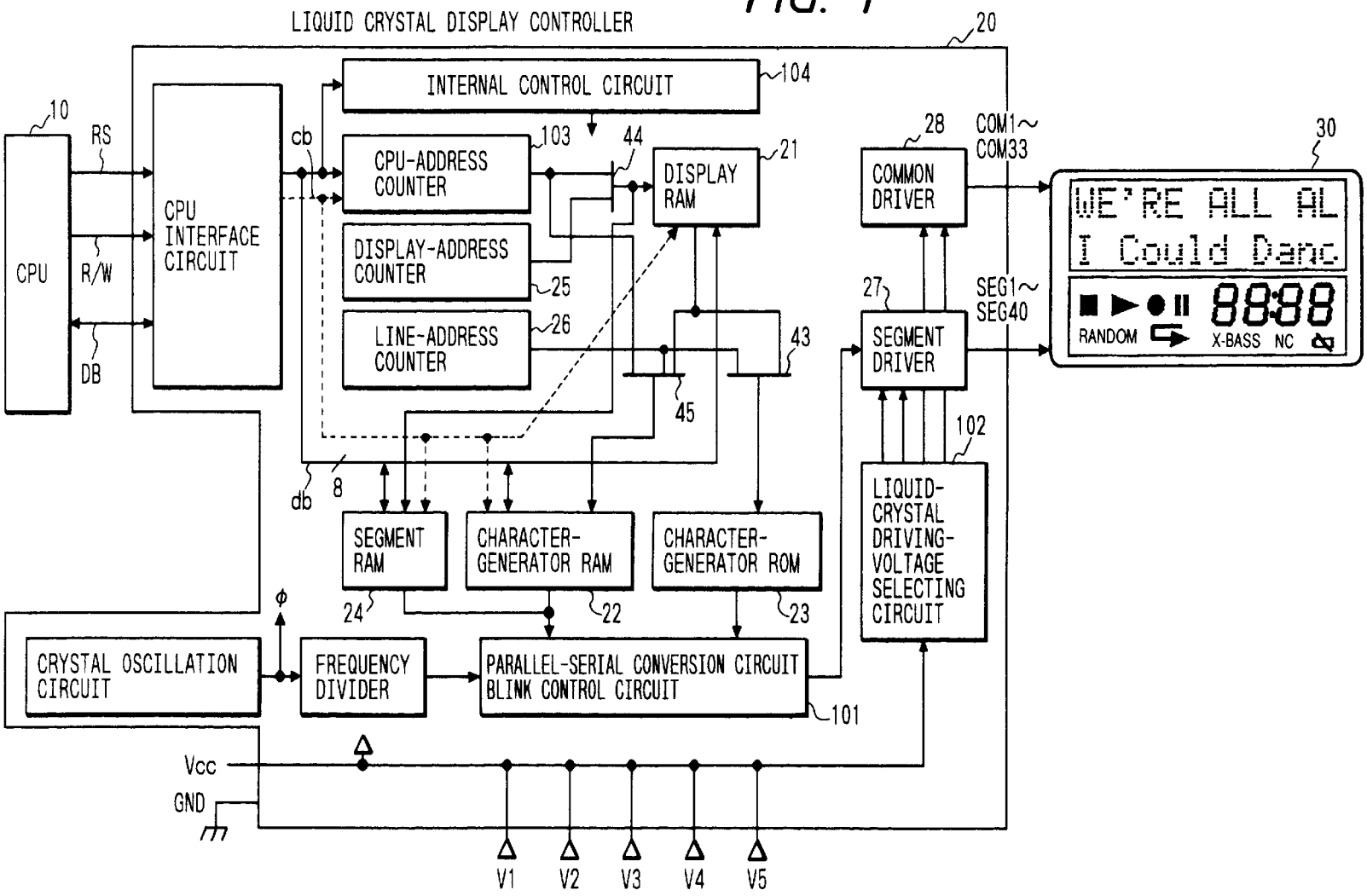
FIG. 1
LIQUID CRYSTAL DISPLAY CONTROLLER
20
30
COM1~COM33
SEG1~SEG40
28
COMMON DRIVER
27
SEGMENT DRIVER
102
LIQUID-CRYSTAL DRIVING-VOLTAGE SELECTING CIRCUIT
101
104
INTERNAL CONTROL CIRCUIT
21
DISPLAY RAM
43
45
44
CHARACTER-GENERATOR ROM
23
CHARACTER-GENERATOR RAM
22
PARALLEL-SERIAL CONVERSION CIRCUIT BLINK CONTROL CIRCUIT
103
CPU-ADDRESS COUNTER
25
DISPLAY-ADDRESS COUNTER
26
LINE-ADDRESS COUNTER
SEGMENT RAM
24
FREQUENCY DIVIDER
cb
8
db
φ
CPU INTERFACE CIRCUIT
CRYSTAL OSCILLATION CIRCUIT
V1
V2
V3
V4
V5
Vcc
GND
RS
R/W
DB
10
CPU
RANDOM
X-BASS
NC

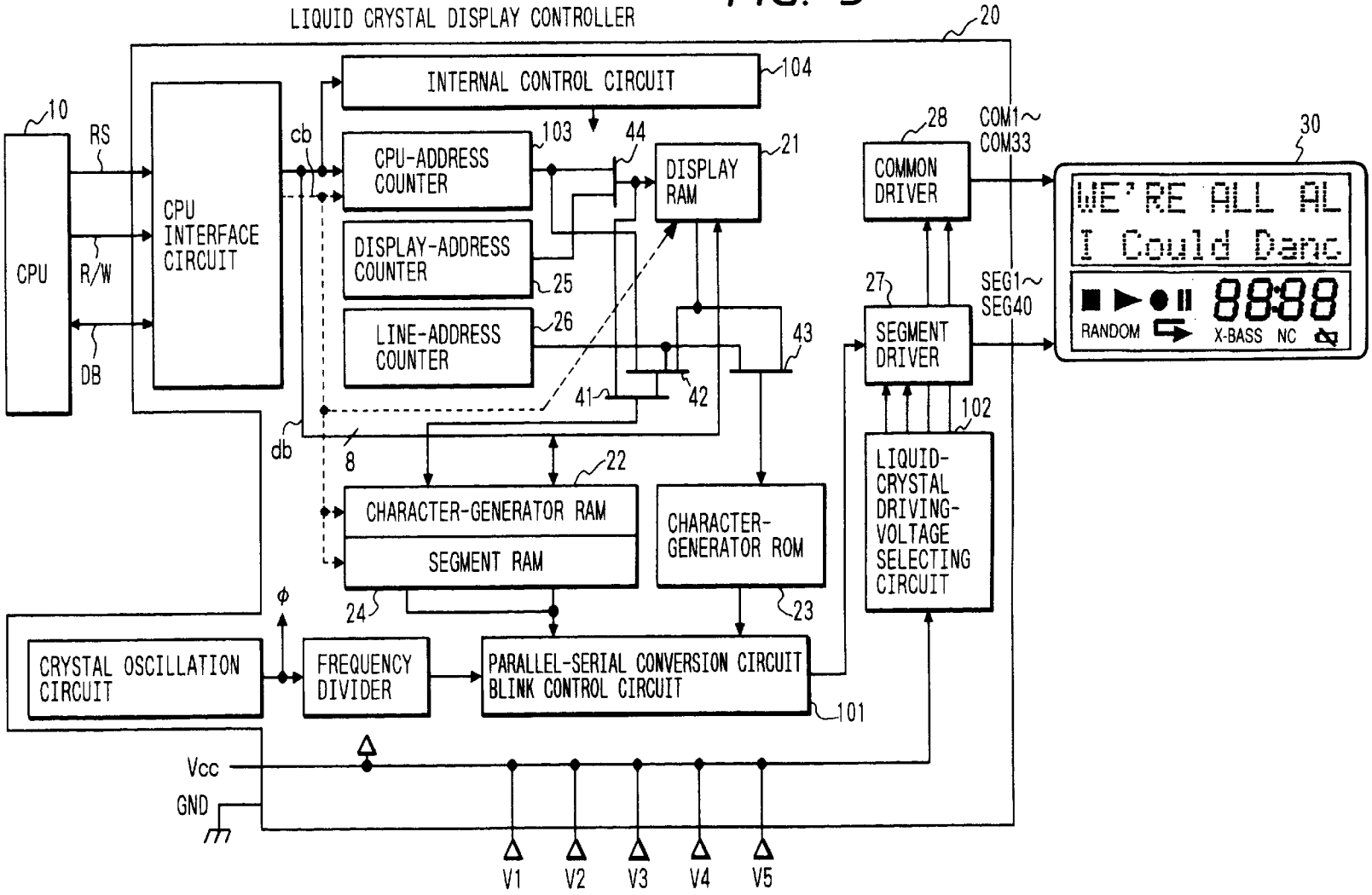
FIG. 3
LIQUID CRYSTAL DISPLAY CONTROLLER
20
30
WE'RE ALL AL
I Could Dance
RANDOM
X-BASS
NC
COM1~COM33
SEG1~SEG40
28
COMMON DRIVER
27
SEGMENT DRIVER
102
LIQUID-CRYSTAL DRIVING-VOLTAGE SELECTING CIRCUIT
104
INTERNAL CONTROL CIRCUIT
21
DISPLAY RAM
43
42
44
41
103
CPU-ADDRESS COUNTER
25
DISPLAY-ADDRESS COUNTER
26
LINE-ADDRESS COUNTER
22
CHARACTER-GENERATOR RAM
SEGMENT RAM
23
CHARACTER-GENERATOR ROM
101
PARALLEL-SERIAL CONVERSION CIRCUIT BLINK CONTROL CIRCUIT
24
FREQUENCY DIVIDER
cb
db
8
φ
CPU INTERFACE CIRCUIT
RS
R/W
DB
10
CPU
CRYSTAL OSCILLATION CIRCUIT
Vcc
GND
V1
V2
V3
V4
V5

LIQUID-CRYSTAL DISPLAY CONTROL APPARATUS

This is a continuation of U.S. application Ser. No. 08/308,830 filed Sep. 19, 1994 now abandoned which is a continuation of U.S. application Ser. No. 08/100,764 filed Aug. 2, 1993 now abandoned.

BACKGROUND OF THE INVENTION

The present invention relates in general to a display control technology and in particular to a technology well applicable to the liquid-crystal driving method such as a technology effectively usable in a display control circuit of a liquid-crystal driving apparatus for displaying dot-matrix characters.

The conventional liquid-crystal driving apparatus for displaying dot-matrix characters comprises a display RAM unit, referred to hereafter as a DDRAM unit, for storing character codes and character-generator RAM and ROM units, referred to hereafter as CGRAM and CGROM units respectively, for storing character font patterns. A CPU (Central Processing Unit) writes codes of characters for display use into DDRAM addresses which correspond to positions on a liquid-display screen. The CPU also writes any arbitrary font patterns into the CGRAM unit. An operation to control liquid-crystal display is carried out as follows. First of all, a liquid-crystal display controller reads out the code of a character stored in the DDRAM unit at an address corresponding to a display position. The code of a character read out from the DDRAM unit is then used as part of an address of the CGRAM or CGROM unit from which a character font pattern is finally read out for display. Accordingly, in order to display a picture pattern other than the dot-matrix characters such a mark or an icon, it is necessary in the case of this configuration to use part of the CGRAM or CGROM unit for dedicatedly storing picture patterns such as marks and icons. An example of a liquid-crystal driving apparatus, that incorporates CGRAM and CGROM units, is the LCD-II made by Hitachi, Ltd. For details of the LCD-II, refer to the HD44780 on Pages 1 to 12 of the user's manual which was published in February 1984.

SUMMARY OF THE INVENTION

As the number of picture patterns such as marks and icons increases, however, the sizes of the portions of the CGRAM and CGROM units required for storing the picture patterns such as marks and icons also increase as well. As a result, the portions of the CGRAM and CGROM units originally intended for storing font patterns of dot-matrix characters inevitably decrease. For example, in order to store 30 picture patterns such as marks and icons in a CGRAM unit of a liquid-crystal display controller, an area for storing font patterns of six 5×8-dot characters is required. Accordingly, if the capacity of the CGRAM unit is originally large enough only for storing font patterns of 8 characters, the number of dot-matrix characters, the font patterns of which can be stored in the remaining portion of the CGRAM unit, is reduced to 2 . Therefore, the number of character font patterns that can be displayed at the same time is limited. As a result, the display control software becomes complicated.

In order to read out picture patterns such as marks and icons stored in the CGRAM and CGROM units, character codes are also required as well. It is thus necessary to write the required character codes in the DDRAM unit in advance. As a result, the picture patterns are difficult to use.

In addition, the conventional CGRAM and CGROM units are used for storing fonts in character units. Accordingly, display control cannot be carried out individually for a picture pattern that corresponds to a bit because information is not stored in bit units. For example, blink control cannot be done only for a particular picture pattern selected from a plurality of picture patterns stored at the same address in the CGRAM or CGROM unit.

The present invention addresses the problems described above. It is an object of the present invention to provide a liquid-crystal display controller for displaying picture patterns such as marks and icons in bit units independently of the display of dot-matrix characters.

Much like the conventional liquid-crystal driving apparatus described above, in order to display a dot-matrix character, first of all, a character code is read out from a display-RAM unit which is accessed using a display address. Display addresses are generated one after another incrementally in accordance with display positions. The character code is then used in conjunction with a line address (raster address) for accessing a character-generator RAM unit or a character-generator ROM unit, from which a character font pattern is read out.

When displaying a particular line separately from the above operation, a display address is used for accessing a segment RAM unit, from which display/no-display information is read out. The display/no-display information read out from the segment RAM unit indicates whether or not a picture pattern such as an icon or a mark is to be displayed. As described above, display addresses are generated one after another in accordance with display positions.

The liquid-crystal driving operation for displaying character font patterns and the liquid-crystal driving operation for displaying picture patterns such as marks and icons are carried out on a time-division basis. Therefore, it is possible to display dot-matrix characters and picture patterns such as marks and icons on the same screen independently of the dot-matrix characters being displayed.

In addition to the aforementioned display/no-display information indicating whether or not a picture pattern such as a mark or an icon is to be displayed, information specifying display-control attributes such as blinking and black/white inversion can be stored for each mark and icon. A blinking attribute or the like for a particular picture pattern can thereby be selected from a plurality of pieces of mark/icon information stored at the same address in the segment RAM unit. It should be noted that the attribute information described above is an optional feature which is not absolutely required.

A liquid-crystal display apparatus provided by the present invention comprises a display RAM unit, character-generator RAM and ROM units and a segment RAM unit. Character codes are read out from the display RAM unit at addresses generated one after another incrementally in accordance with display positions. Character font patterns are read out from the character-generator RAM and ROM units locations specified by the character codes read out from the display RAM unit. On the other hand, the segment RAM unit is accessed directly by using the addresses generated one after another incrementally in accordance with display positions. Bit patterns read out from the segment RAM unit are used in the display control of picture patterns such as marks and icons. The character-generator RAM and ROM units and the segment RAM unit are accessed for displaying characters and picture patterns such as marks and icons respectively at their display positions on a time-division basis. Therefore, it becomes possible to display dot-matrix characters as well as picture patterns such as marks and icons on the same screen independently of the dot-matrix characters being displayed.

In addition to the display/no-display information for specifying whether or not a picture pattern is to be displayed, attribute information describing a display method for each picture pattern can be included in the data read out from the segment RAM unit through direct accesses using addresses generated one after another incrementally in accordance with display positions. The additional information allows display control such as blinking individual marks and icons to be carried out.

BRIEF DESCRIPTION OF THE DRAWINGS

FIG. 1 shows an embodiment implementing a liquid-crystal display control system in accordance with the present invention;

FIG. 3 shows another embodiment implementing a liquid-crystal display control system having a configuration different from that shown in FIG. 1 in accordance with the present invention;

DESCRIPTION OF THE PREFERRED EMBODIMENTS

Figure 2:
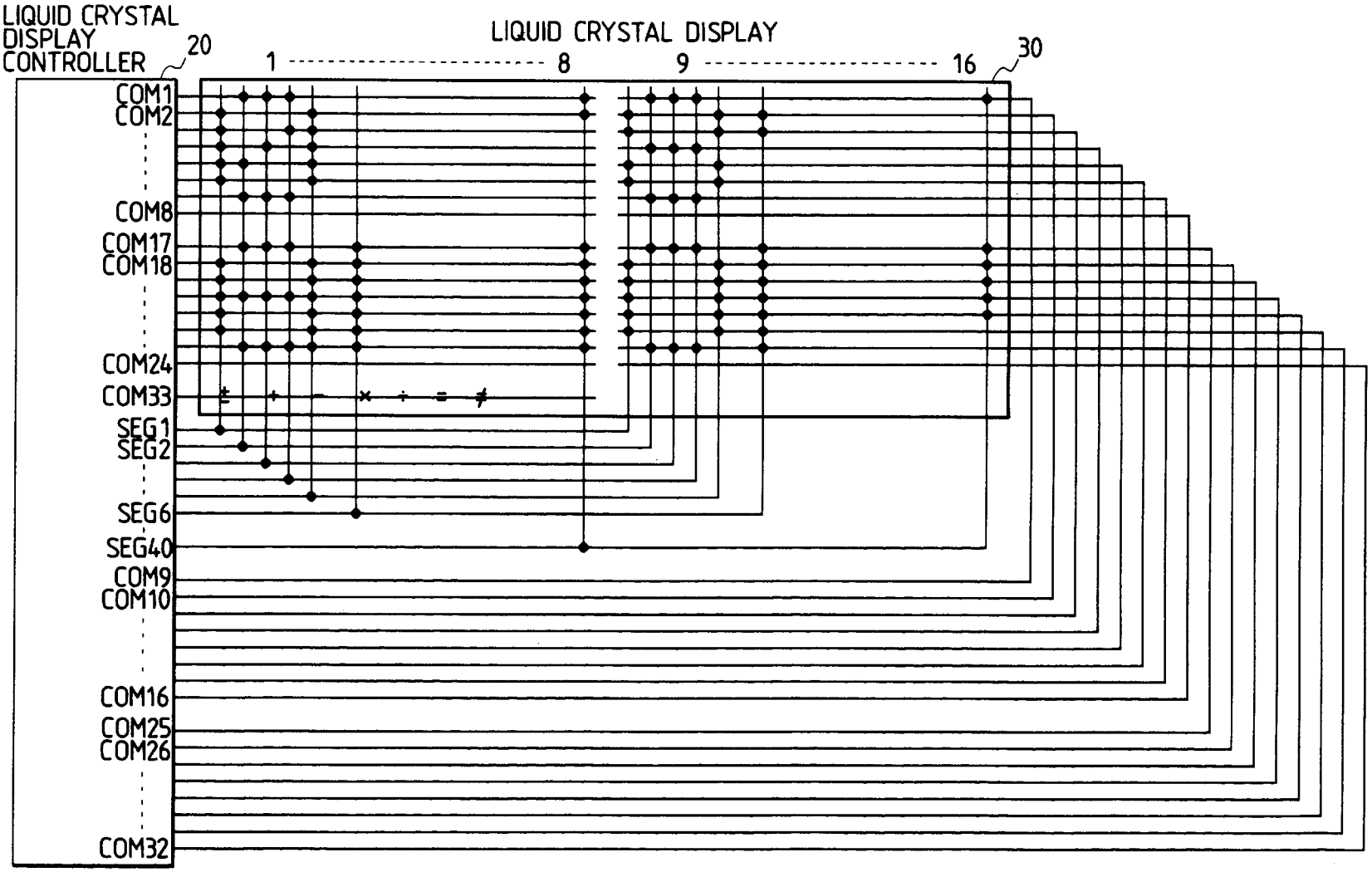
FIG. 2 shows a typical liquid-crystal display provided by the present invention.

FIG. 1 shows an embodiment implementing a liquid-crystal display control system in accordance with the present invention. As shown in the figure, the system comprises a CPU 10 for executing a display-control program, a liquid-crystal controller 20 controlled by instructions issued by the CPU 10 and a liquid-crystal display unit 30 controlled by the liquid-crystal controller 20. The liquid-crystal controller 20 is a single chip created on a semiconductor substrate made of syngle-crystal silicon by using a widely known semiconductor manufacturing technology. The liquid-crystal controller 20 comprises components embedded in the chip including a CPU interface circuit, a crystal-controlled oscillation circuit, a display RAM unit 21 for storing character codes, character-generator RAM and ROM units 22 and 23 for storing character font patterns and a segment RAM unit 24 for storing picture patterns such as marks and icons. The display RAM unit 21, the character-generator RAM and ROM units 22 and 23 and the segment RAM unit 24 are each allocated an address space. The address spaces allocated to the display RAM unit 21, the character-generator RAM and ROM units 22 and 23 and the segment RAM unit 24 are different from each other. The CPU 10 can freely update the contents of the display RAM unit 21, the character-generator RAM unit 22 and the segment RAM unit 24. The CPU 10 supplies a register-select signal RS, a read/write signal R/W and data to the CPU interface circuit. The register-select signal RS means selection (write in or read out) of a CPU address counter 103, at a low level. The register select signal RS means selection (write in or read out) of the display RAM 21, the character-generator RAM 22 and the segment RAM 24, at a high level. Information conveyed by the register-select signal RS and the read/write signal R/W supplied to the CPU interface circuit is forwarded to each module through an internal control bus CB.

Let us take an operation to update data stored in the display RAM unit 21 as an example. First of all, the CPU 10 asserts the register-select signal RS at a low level, supplying it to the CPU interface circuit. As described before, the register-select signal RS is set at a low level to indicate that an address is about to be written into the CPU address counter 103. Then, data supplied by the CPU 10, a predetermined address in the display RAM unit 21, is loaded into the CPU address counter 103 through an external data bus DB, the CPU interface circuit and an internal data bus db. Next, the CPU 10 supplies the register-select signal RS at a high level and the read/write signal R/W at a low level to the CPU interface circuit to indicate a write mode for the RAM units. The CPU 10 then supplies information to an internal control circuit 104 through the external data bus DB, the CPU interface circuit and the internal data bus db. Receiving the information from the CPU 10, the internal control circuit 104 requests an address multiplexer 44 to select the output of the CPU address counter 103 as its output. In this way, the predetermined display RAM address previously loaded into the CPU address counter 103 is supplied to the display RAM unit 21. Data is further supplied by the CPU 10 to the display RAM unit 21 through the external data bus DB, the CPU interface circuit and the internal data bus db. The data is written into the display RAM unit 21 at a location specified by the display RAM address received from the CPU address counter 103. This event marks the completion of the operation to update data stored in the display RAM unit 21.

Next, let us think of an operation to update data stored in the segment RAM unit 24. First of all, the CPU 10 asserts the register-select signal RS at a low level, supplying it to the CPU interface circuit as in the case of the operation to update data stored in the display RAM unit 21. As described before, the register-select signal RS is set at a low level to indicate that an address is about to be written into the CPU address counter 103. Then, an address in the segment RAM unit 24 is loaded into the CPU address counter 103 through the external data bus DB, the CPU interface circuit and the internal data bus db. Next, the CPU 10 supplies the register-select signal RS at a high level and the read/write signal R/W at a low level to the CPU interface circuit to indicate a write mode for the RAM units. The CPU 10 then supplies information to the internal control circuit 104 through the external data bus DB, the CPU interface circuit and the internal data bus db. Receiving the information from the CPU 10, the internal control circuit 104 requests the address multiplexer 44 to select the output of the CPU address counter 103 as its output. In this way, the segment RAM address previously loaded into the CPU address counter 103 is supplied to the segment RAM unit 24. Data is further supplied by the CPU 10 to the segment RAM unit 24 through the external data bus DB, the CPU interface circuit and the internal data bus db. The data is written into the segment RAM unit 24 at a location specified by the segment RAM address received from the CPU address counter 103. This event marks the completion of the operation to update data stored in the segment RAM unit 24.

Finally, let us consider an operation to update data stored in the character-generator RAM unit 22. First of all, the CPU 10 asserts the register-select signal RS at a low level, supplying it to the CPU interface circuit as in the case of the operation to update data stored in the display RAM unit 21. As described before, the register-select signal RS is set at a low level to indicate that an address is about to be written into the CPU address counter 103. Then, an address in the character-generator RAM unit 22 is loaded into the CPU address counter 103 through the external data bus DB, the CPU interface circuit and the internal data bus db. Next, the CPU 10 supplies the register-select signal RS at a high level and the read/write R/S signal at a low level to the CPU interface circuit to indicate a write mode for the RAM units. The CPU 10 then supplies information to the internal control circuit 104 through the external data bus DB, the CPU interface circuit and the internal data bus db. Receiving the information from the CPU 10, the internal control circuit 104 requests the address multiplexer 44 to select the output of the CPU address counter 103 as its output. In this way, the character-generator RAM address previously loaded into the CPU address counter 103 is supplied to the character-generator RAM unit 22. Data is further supplied by the CPU 10 to the character-generator RAM unit 22 through the external data bus DB, the CPU interface circuit and the internal data bus db. The data is written into the character-generator RAM unit 22 at a location specified by the segment RAM address received from the CPU address counter 103. This event marks the completion of the operation to update data stored in the character-generator RAM unit 22.

Based on a clock signal ϕ generated by the crystal-controlled oscillation circuit at a predetermined frequency, a display-address counter 25 generates display addresses one after another incrementally in accordance with screen display positions. Also based on the clock signal ϕ generated by the crystal-controlled oscillation circuit at the predetermined frequency, on the other hand, a line-address counter 65 generates raster addresses one after another incrementally in accordance with the raster position of each character display being driven. When displaying a character, the following control is carried out. First of all, the internal control circuit 104 requests the address multipexer 44 to select a display RAM address generated by the display-address counter 25 as its output to be supplied to the display RAM unit 21. Receiving the display RAM address from the address multiplexer 44, the display RAM unit 21 outputs a character code. Then, address multiplexers 43 and 45 forward this character code along with a raster address generated by the line-address counter 26 as a display address. If the display-address is a character-generator RAM address, a character font pattern is read out from the character-generator RAM unit 22. If the display-address is a character-generator ROM address, however, a character font pattern is read out from the character-generator ROM unit 23 instead. The character font pattern is then displayed. When displaying a picture pattern such as a mark or an icon, on the other hand, the following control is carried out. First of all, the internal control circuit 104 requests the address multiplexer 44 to select a segment RAM address generated by the display-address counter 25 as its output to be supplied to the segment RAM unit 24. Receiving the segment RAM address from the address multiplexer 44, the segment RAM unit 24 outputs display control information. Characters and picture patterns such as marks and icons are displayed on the same screen on a time-division basis. There is no special limitation on the size of the character font and the number of displayed characters ((the number of digits)×(the number of rows)).

Figure 5:
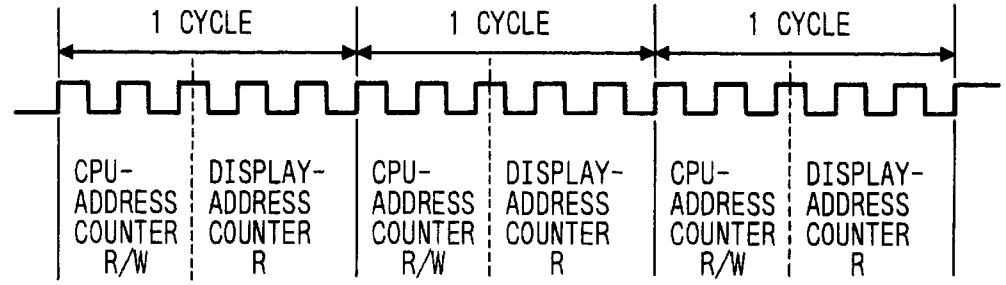
FIG. 5 is a time chart showing a state of operation in each cycle of a liquid-crystal display controller provided by the present invention.

The liquid-crystal display controller 20 provided by the present invention utilizes the clock signal ϕ generated by the embedded crystal-controlled oscillation circuit as a base clock signal. In accordance with the base clock signal, data is read out from and written into the display RAM unit 21, the character-generator RAM unit 22 and the segment RAM unit 24 at addresses output by the CPU address counter 103. In addition, data is also read out from and written into the display RAM unit 21, the character-generator RAM unit 22 and the segment RAM unit 24 at addresses output by the display-address counter 25. As shown in FIG. 5, a read operation at an address generated by the display-address counter 25 is carried out in the liquid-crystal controller provided by the present invention right after a read/write operation at an address output by the CPU address counter 103. A read operation at an address generated by the display-address counter 25 and a read/write operation at an address output by the CPU address counter 103 constitute a cycle.

In the display example shown in FIG. 2, a 5×8-dot character font is displayed in an ((8 digits)×(4 rows)) format. In the example shown in FIG. 2, in order to display 5×8-dot character fonts from 1st to 32nd lines on four rows, data is read out from the display RAM unit 21 and the character-generator RAM and ROM units 22 and 23. To be more specific, a character font pattern of 8 rasters for the first row is read out through the 1st to 8th lines. Similarly, character font patterns for the 2nd, 3rd and 4th rows are read out through the 9th to 16th lines, the 17th to 24th lines and the 25th to 32nd lines. In addition, in order to display a picture pattern such as a mark and an icon on the 33rd line, data is read out from the segment RAM unit 24. Display patterns read out from the character-generator RAM unit 22 or the character-generator ROM unit 23 and the segment RAM unit 24 are output by segment drivers 27 employed in the liquid-crystal display controller 20 shown in FIG. 1 on a time-division basis, to drive the liquid-crystal display unit 30. In the time-division based driving operation, driving lines are selected by common drivers 28 of the liquid-crystal display controller 20. In the example shown in FIG. 2, forty segment drivers 27 and thirty-three common drivers are employed, allowing a maximum of thirty-two 5×8-dot characters, corresponding to (8 digits×4 rows), and 40 different picture patterns such as marks and icons to be displayed.

The character-generator RAM unit 22 and the segment RAM unit 24 are shown in FIG. 1 as independent components. It should be noted, however, that both the units are accessed on a time-division basis and have address spaces different from each other as described earlier. Accordingly, the segment RAM unit 24 and the character-generator unit 22 can be implemented as a single RAM module with a contiguous address space for both. An embodiment of a liquid-crystal display controller 20 for such implementation is shown in FIG. 3. Also in this case, however, the address spaces are different from each other even though they may be contiguous and the single RAM module is accessed at addresses of the two different address spaces on a time-division basis. Driven by a control signal from an internal control circuit 104, an address multiplexer 41 switches from an access address to a read address accessed in a display operation or vice verse. By an access address, an address at which the CPU 10 accesses the character-generator RAM unit 22 or the segment RAM unit 24 is meant. For example, when the CPU 10 updates data stored in the character-generator RAM unit 22 or the segment RAM unit 24, the address multiplexer 41 selects an address for the character-generator RAM unit 22 or the segment RAM unit 24 generated by the CPU address counter 103 as its output supplied to the single RAM module. When the liquid-crystal display controller 20 displays data on the liquid-crystal display unit 30, on the other hand, the address multiplexer 41 forwards the output of the address multiplexer 42 to the single RAM module. When the liquid-crystal display controller 20 displays data on the liquid-crystal display unit 30, the address multiplexer 42 selects an address for reading the segment RAM unit 24 or an address for reading the character-generator RAM unit 22.

Figure 4:
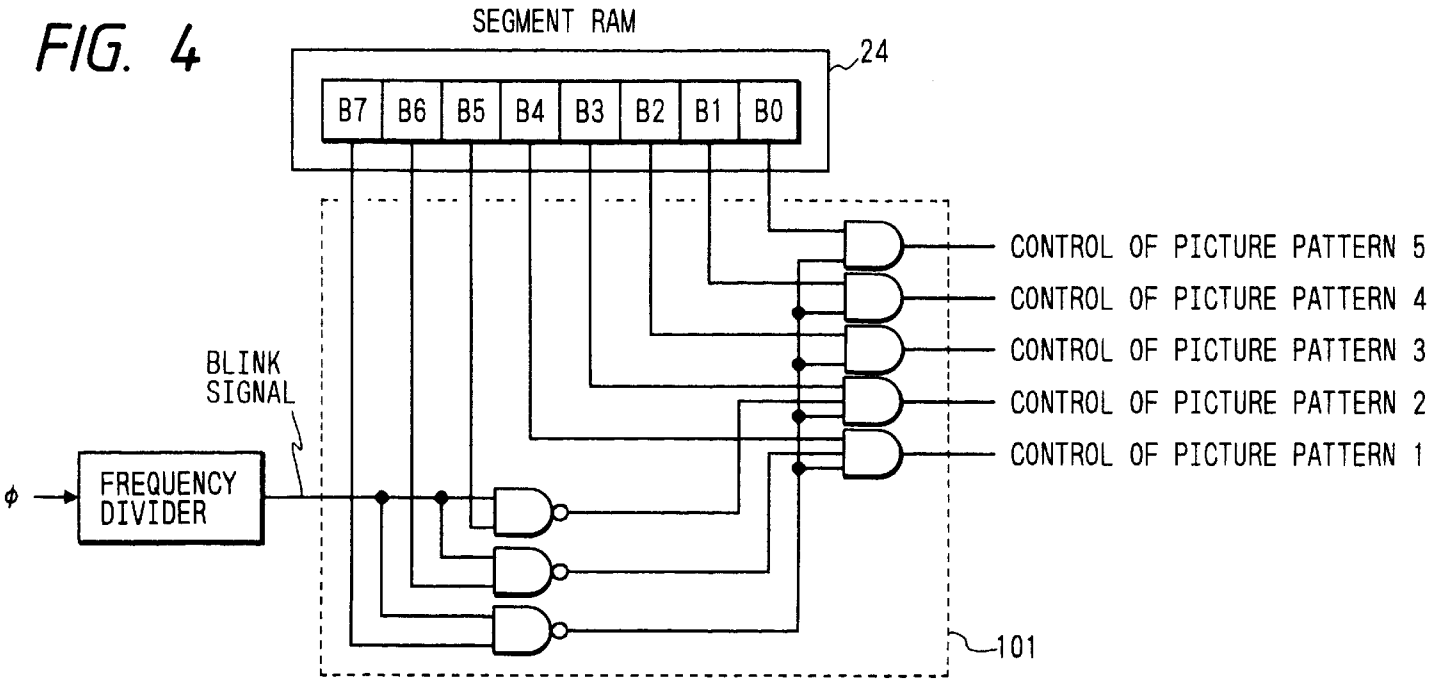
FIG. 4 shows a typical format of data stored in a segment RAM unit 24 provided by the present invention for displaying picture patterns such as marks and icons.

A typical data format in which picture patterns such as marks and icons are stored in the segment RAM unit 24 is shown in FIG. 4. Eight-bit display control information is stored in the segment RAM unit 24 at an address location. The low-order 5 bits, bit 0 to bit 4, of a piece of the display control information are a field for storing display/no-display information of five picture patterns such as marks and icons. Each bit indicates whether or not a picture pattern is to be turned on. Bit 7, the highest-order bit, represents attribute information which indicates that turned-on picture patterns of the five picture patterns of marks and icons are to be displayed in a blinking mode. Bits 6 and 5 are attribute information associated with picture patterns specified to be turned on by bits 4 and 3 respectively. That is to say, bits 6 and 5 indicate that these picture patterns are to be displayed in a blinking mode if they are turned on. The blinking period is determined by a blinking signal which is obtained by dividing the frequency of the clock signal $\phi$ by means of a frequency divider.

According to the present invention, a segment RAM unit for storing picture patterns such as marks and icons is provided separately from character-generator RAM/ROM units for storing font patterns of dot-matrix characters as described above. Accordingly, the display of picture patterns such as marks and icons can be controlled in bit units. In addition, a liquid-crystal display unit is driven by data which is read out from the segment RAM unit and the character-generator RAM/ROM units on a time-division basis. As a result, it is possible to display font patterns of dot-matrix characters and picture patterns such as marks and icons on the same screen.

What is claimed is:

1. A liquid-crystal display system comprising:

a liquid-crystal display unit having a plurality of first common lines, a plurality of segment lines each of which is arranged to cross the plurality of first common lines to form dots to be used for displaying a plurality of character font patterns, and a single second common line having a plurality of parts each of which is defined by overlapping the second common line with one of the plurality of segment lines and each of which forms a predetermined picture pattern; and a liquid-crystal display controller, formed on a semiconductor chip, coupled to said liquid-crystal display unit, and including:

a common driver, coupled to the first common lines and to the second common line, and for cyclically driving each of the first common lines and the second common line;

a display memory for storing a plurality of character codes;

a character read-only memory coupled to the display memory for storing a plurality of character font patterns each corresponding to one of said character codes stored in said display memory, the character read-only memory outputting a character font pattern in response to an output of a character code from the display memory, wherein each of said plurality of character font patterns is displayed by a plurality of dots being formed by said plurality of first common lines and said plurality of segment lines;

a segment memory for storing at least segment control information for indicating whether or not a predetermined picture pattern in the liquid-crystal display unit is displayed, wherein each individual bit of said segment control information corresponds to one predetermined picture pattern being formed on each of said plurality of parts being formed by overlapping said second common line with said plurality of segment lines;

segment line driving means, coupled to the character read-only memory, to the segment memory and to the segment lines, for driving the segment lines in accordance with one bit of the segment control information from the segment memory and character font information for representing the character font pattern outputted from the character read-only memory; and address outputting means for generating a display address, the generated display address being only supplied to the display memory in synchronization with the driving of the first common lines, and the generated display address being only supplied to the segment memory in synchronization with the driving of the second common line such that a picture pattern is displayed.

2. The liquid-crystal display system according to claim 1, wherein said segment line driving means includes a parallel-serial conversion circuit coupled to the character read-only memory and to the segment memory for converting one of the segment control information from the segment memory and character font information for representing the character font pattern outputted from the character read-only memory to serial information, and a segment driver coupled to said parallel-serial conversion circuit and to the segment lines for driving the segment lines in accordance with the serial information from said parallel-serial conversion circuit.

3. The liquid-crystal display system according to claim 2, wherein said liquid-crystal display controller further comprises:

a rewritable character memory coupled to said display memory for storing a plurality of character font patterns each corresponding to one of said character codes stored in said display memory, wherein said segment line driving means is further coupled to said rewritable character memory and for driving the segment lines in accordance with one of the segment control information from said segment memory and character font information for representing said character font pattern outputted from one of said character read-only memory and said rewritable character memory.

4. The liquid-crystal display system according to claim 3, wherein said segment line driving means includes a parallel-serial conversion circuit coupled to said character read-only memory, to said rewritable character memory and to said segment memory for converting one of said segment control information from said segment memory and character font information for representing said character font pattern outputted from one of said character read-only memory and said rewritable character memory to serial information, and a segment driver coupled to said parallel-serial conversion circuit and to said segment lines for driving said segment lines in accordance with said serial information from said parallel-serial conversion circuit.

5. The liquid-crystal display system according to claim 4, wherein said address outputting means further comprises rewrite-address outputting means for generating a rewrite address indicating an address in said display memory, said rewrite character memory and said segment memory to change one of said character codes stored in said address, said character font pattern stored in said address and said segment control information stored in said address.

6. The liquid-crystal display system according to claim 5, wherein address spaces different from each other are individually allocated to said display memory, said rewritable character memory and said segment memory.

7. The liquid-crystal display system according to claim 6, wherein said segment memory further stores blinking information for indicating whether or not said predetermined picture pattern to be displayed is to be blinked.

8. The liquid-crystal display system according to claim 1, wherein said address outputting means further comprises rewrite-address outputting means for generating a rewrite address indicating an address in one of said display memory and said segment memory to change one of a character code stored in said address and said segment control information stored in said address.

9. The liquid-crystal display system according to claim 8, wherein address spaces different from each other are individually allocated to said display memory and said segment memory.

10. The liquid-crystal display system according to claim 9, wherein said segment memory further stores blinking information for indicating whether or not said predetermined picture pattern to be displayed is to be blinked.

* * * * *